US008201705B2

(12) United States Patent
Williamson

(10) Patent No.: US 8,201,705 B2
(45) Date of Patent: Jun. 19, 2012

(54) PORTABLE SAFETY DISH

(76) Inventor: Nelson Todd Williamson, Brooklyn, NY (US)

( * ) Notice: Subject to any disclaimer, the term of this patent is extended or adjusted under 35 U.S.C. 154(b) by 457 days.

(21) Appl. No.: 12/327,281

(22) Filed: Dec. 3, 2008

(65) Prior Publication Data

US 2009/0152277 A1 Jun. 18, 2009

Related U.S. Application Data

(60) Provisional application No. 60/992,017, filed on Dec. 3, 2007.

(51) Int. Cl.
*B65D 55/14* (2006.01)

(52) U.S. Cl. ..... 220/210; 200/574.1; 200/575; 70/3; 70/158

(58) Field of Classification Search ..... 220/210, 220/574.1, 575; 70/3, 158
See application file for complete search history.

(56) References Cited

U.S. PATENT DOCUMENTS 3,107,027 A * 10/1963 Hong ..... 220/23.8
3,610,177 A * 10/1971 Shapiro ..... 109/50
4,796,768 A 1/1989 Stuckey
4,834,251 A 5/1989 Yu
5,325,969 A * 7/1994 Gordon et al. ..... 206/546
5,524,779 A 6/1996 Faile
5,787,839 A * 8/1998 Magnant et al. ..... 119/51.5
5,911,764 A 6/1999 Wei Kong
6,612,455 B2 9/2003 Byrne
6,912,878 B2 7/2005 Belden, Jr.
6,988,642 B2 1/2006 Gallo, Jr. et al.
7,175,038 B2 2/2007 Dolan
7,252,204 B1 8/2007 Small
7,350,655 B2 4/2008 Belden, Jr.
7,397,375 B2 7/2008 Marsilio et al.
2005/0263411 A1 * 12/2005 Harrington ..... 206/1.5

* cited by examiner

*Primary Examiner* — Anthony Stashick
*Assistant Examiner* — Elizabeth Volz
(74) *Attorney, Agent, or Firm* — The Marbury Law Group PLLC

(57) ABSTRACT

A safety dish forms a secure food container and has a dish for holding food, a cover for enclosing the dish and food, and a lock mechanism for securing the cover to the dish to prevent unauthorized access to the food and/or tampering with the food. A key or correct input of a combination is required to access the food contents of the container. The safety dish preferably includes a handle and is formed from dishwasher-safe and microwave-safe materials.

5 Claims, 3 Drawing Sheets

PORTABLE SAFETY DISH

RELATED APPLICATIONS

This application claims the benefit of Provisional Application Ser. No. 60/992,017 filed Dec. 3, 2007, which is hereby incorporated by reference.

BACKGROUND

While many food containers have lids that snap or "lock" onto the container to retain the food inside the container (e.g., Tupperware® and VERSAtainer™), these containers do not secure the food from unauthorized access or tampering.

The issues of tampering and access have been addressed in the prior art with respect to bottles for medications and the like through the use of child-proof caps and single-use tamper-indicating rings, tabs, foils and the like, as well as locking medicine cabinets.

While medications have been determined to be worthy of such means for protection from tampering and access, the prior art has not considered meal dishes to be worthy of protection from tampering and unauthorized access.

BRIEF SUMMARY

The disclosed embodiments provide a portable food container that includes a lock mechanism to secure the stored food from unauthorized access and/or tampering. The food container has a lower dish portion that holds the food, a cover, and a lock mechanism to secure the cover to the dish. The cover can optionally include a handle to aid in portability and handling, and the dish, cover, lock and handle are preferably microwave-safe and dishwasher-safe.

As used herein, the term "dish" refers to any dish, plate, bowl or the like used to hold a meal, pie, cake, or other food item. The terms "cover," "top" or "lid" refer to any device used to cover the open-top of the dish to prevent access to and tampering with the inside of the food container. The term "lock mechanism" refers to devices that cannot be opened without a "key," wherein the term "key" comprises physical keys, magnetic keys, combinations, biometrics, and other similar reusable devices used to control access.

DETAILED DESCRIPTION

Figure 1:
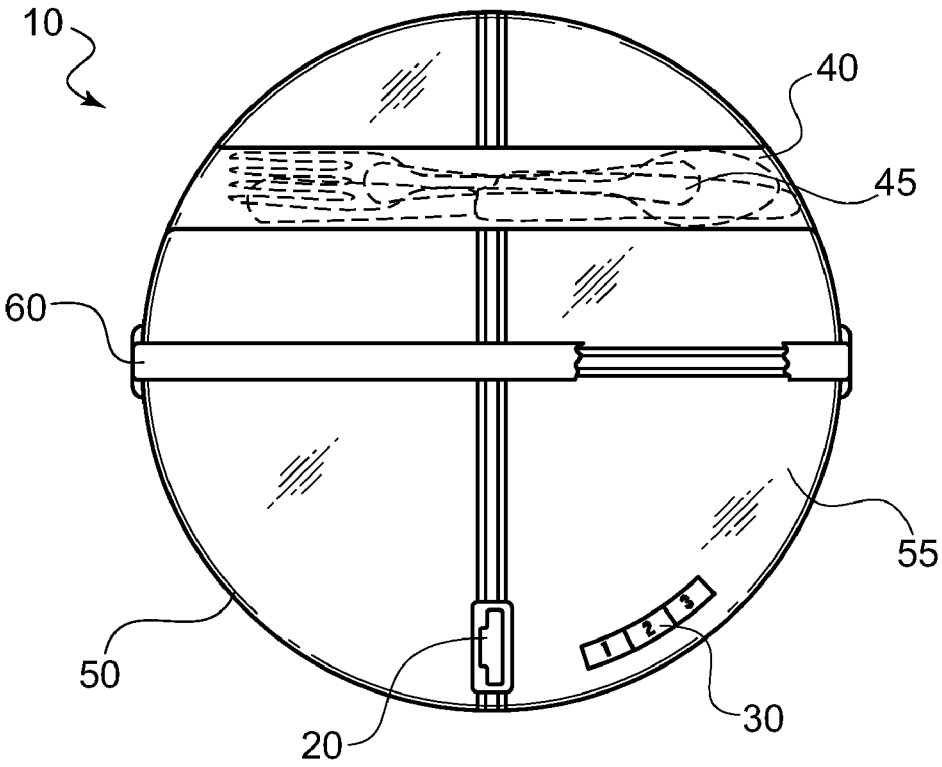
FIG. 1 illustrates a top view of a first embodiment.
Figure 2:
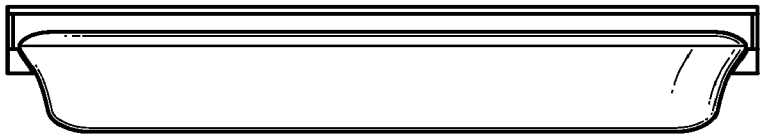
FIG. 2 illustrates a side view of the first embodiment.
Figure 3:
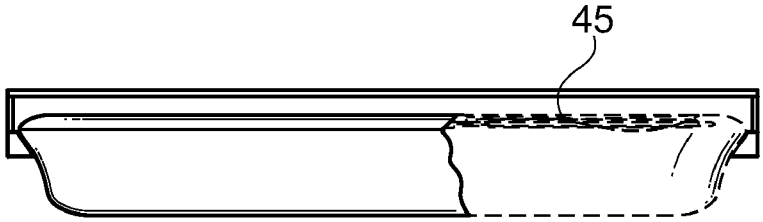
FIG. 3 illustrates a cut-away side view of the first embodiment.

With reference to FIGS. 1-3, a first embodiment of a safety dish 10 is illustrated. In the top-view of FIG. 1, the safety dish

10 forms a secure food container. The lid or cover 50 can optionally be clear (as illustrated) and is secured to the multi-compartment dish 55 of the container with a keyed lock 20 or a combination lock 30 so as to prevent access or tampering with the contents. The cover 50 can optionally include a utensil storage compartment 40, preferably accessible only from the underside of the cover 50 so as to store utensils 45 in a secure manner, as illustrated in FIG. 3. While the utensil storage compartment 40 can be used to hold any type of utensil, it may be preferable to supply a set formed of microwave-safe and dishwasher-safe material as part of the safety dish 10.

The safety dish 10 can include a handle 60 for carrying and handling purposes. The handle 60 can be attached to either the dish 55 or the cover 50 and can be removable or integral. One manner of making the handle 60 removable is illustrated in FIGS. 1-3. In this embodiment, a central portion of the handle 60 is able to flex. Either end of the handle 60 includes gripping portions that rotate inward and are further pressed into the dish when the handle 60 is lifted, but which rotate outward and ease their grip when the handle 60 is pushed down so as to let the handle 60 be removed. One of skill in the art will recognize that many other means can also be used to make the handle 60 selectively removable without departing from the claimed invention.

Figure 4:
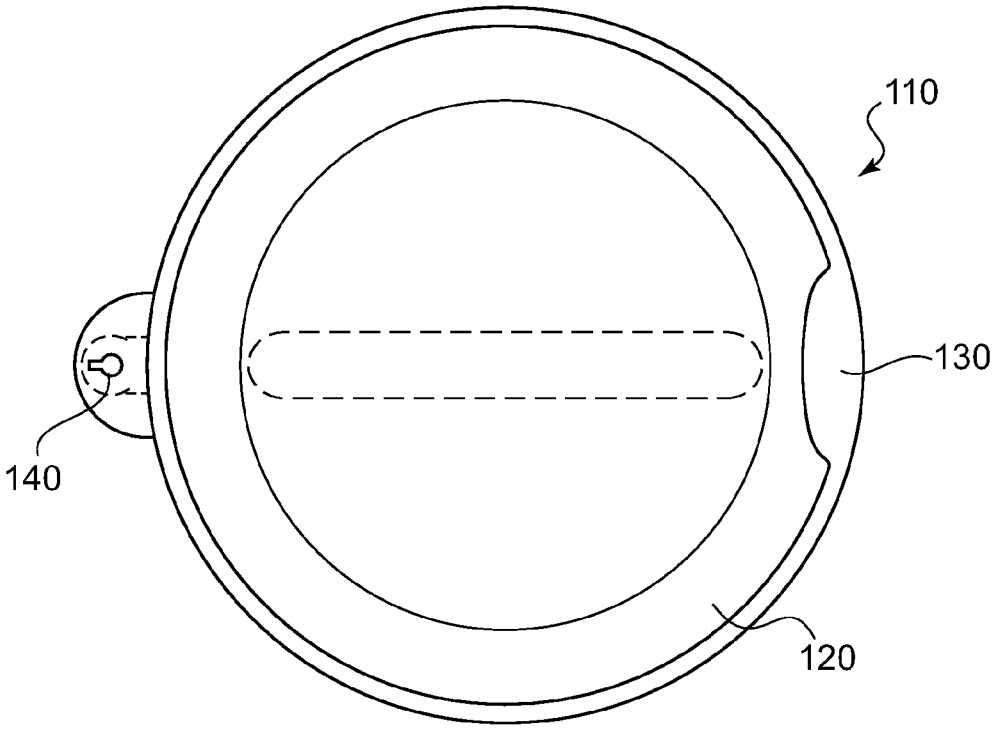
FIG. 4 illustrates a top view of a dish of a second embodiment.
Figure 5:
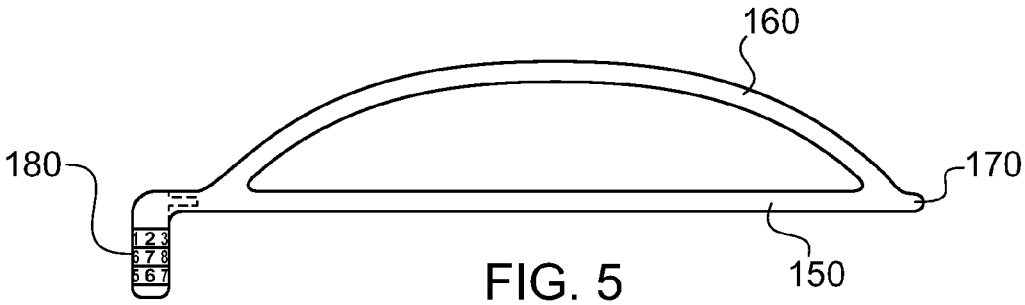
FIG. 5 illustrates a sectional side view of a cover of the second embodiment.
Figure 6:
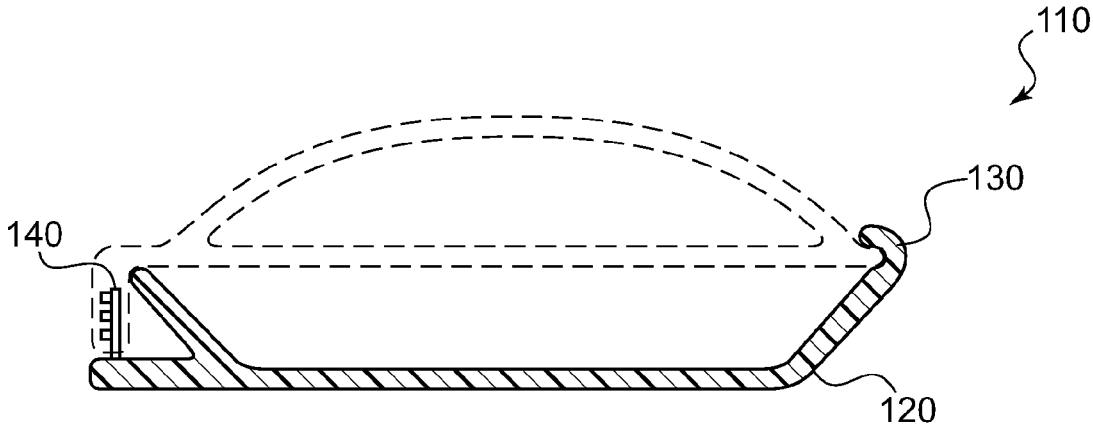
FIG. 6 illustrates a sectional side view of the dish of the second embodiment.

With reference to FIGS. 4 and 6, a top view and side view of a second embodiment of safety dish 110 is illustrated, with the cover shown in phantom so as to illustrate details of the dish 120. While illustrated as generally circular, the dish 120 can take any practical shape, including but not limited to ovals, ovoids (egg-shapes), squares, rectangles, triangles, pentagons, etc. The sidewalls of dish 120 can be angled (as illustrated) or vertical (not shown) or curved (not shown). A recess 130 engages a first portion of a lid or cover and a toothed pin 140 engages another portion of the lid or cover. The lid or cover 150 is illustrated in FIG. 5 and includes a portion or tab 170 that fits into recess 130. At an opposite side of the cover 150, a set of rotating discs 180 with notches is provided to engage with the toothed pin 140 to form a combination lock mechanism. While illustrated as having rotating discs 180 on the cover 150 and toothed pin 140 on the dish 120, it is also possible to have the rotating disc portion of the lock on the dish and the toothed pin portion of the lock on the cover. Similarly, the positions of the tab 130 and recess 170 can also be reversed.

The cover 150 can optionally include a handle 160 and a utensil storage compartment (not shown). If the handle 160 is oriented in line with the lock/tab/recess, it will add strength to the cover 150 to resist against "jimmying" of the lock. The handle 160 illustrated in FIG. 5 is integral with the cover and is preferably formed from dishwasher-safe and microwave-safe material (glass, ceramic, plastic, etc.). When used in a microwave, the handle 160 is preferably fabricated so that it will remain cool to allow a user to grasp the handle 160 to remove the safety dish 110 from the microwave after heating. The dish 120 and elements 140 and 180 of the lock mechanism are also preferably formed from dishwasher-safe and microwave-safe materials. Further, if the lock is not microwave-safe (i.e., metal), the lock can be removable, with a first element 180 horizontally removable and the second element 140 vertically removable so that, despite being removable, they keep each other securely in place when locked together.

Figure 7:
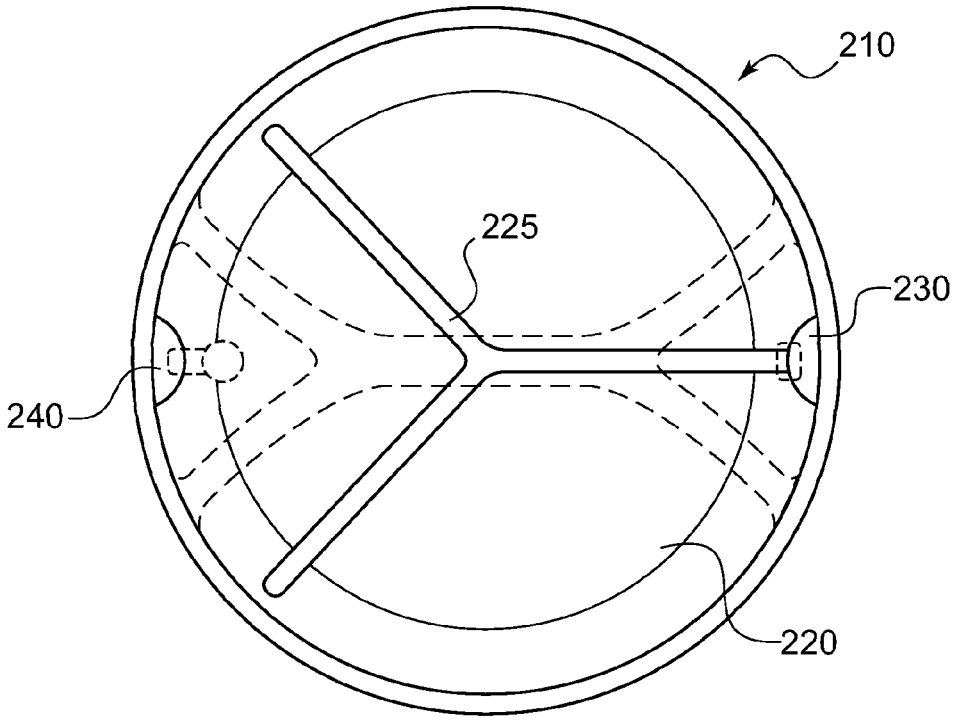
FIG. 7 illustrates a top view of a dish of a third embodiment.
Figure 8:
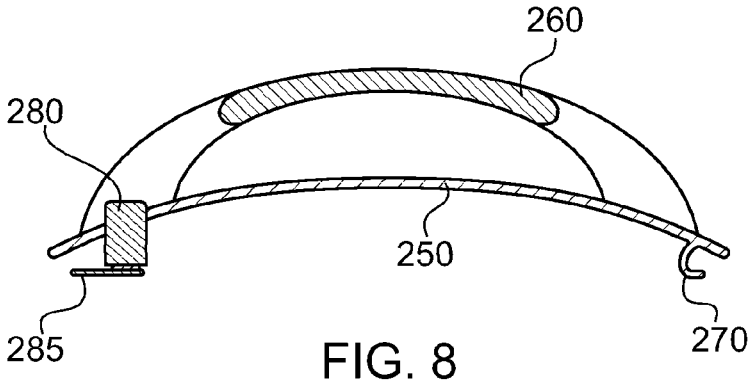
FIG. 8 illustrates a sectional side view of a cover of the third embodiment.
Figure 9:
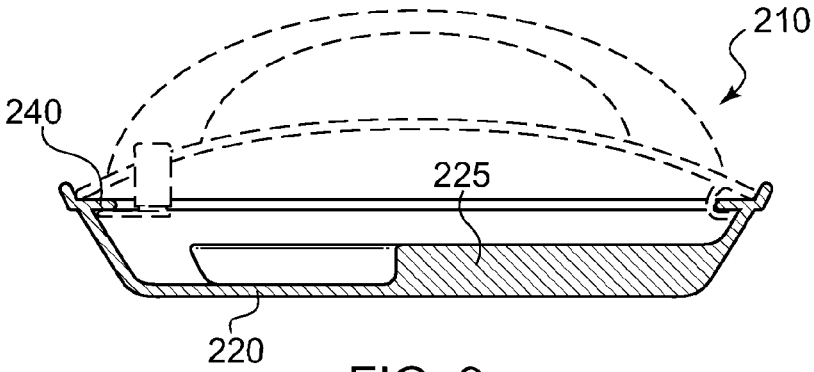
FIG. 9 illustrates a sectional side view of the dish of the third embodiment.

With reference to FIGS. 7 and 9, a top view and side view of a third embodiment of safety dish 210 is illustrated, with the cover shown in phantom so as to illustrate details of the dish 220. While illustrated as generally circular, the dish 220 can take any practical shape, including but not limited to ovals, ovoids (egg-shapes), squares, rectangles, triangles, pentagons, etc. and can include one or more dividing walls 225 to separate food items. The sidewalls of dish 220 can be angled (as illustrated) or vertical (not shown) or curved (not shown). A tab 230 engages a first portion of a lid or cover and a tab 240 engages another portion of the lid or cover. The lid or cover 250 is illustrated in FIG. 8 and includes a portion or recess 270 that engages tab 230. At an opposite side of the cover 250, a keyed lock cylinder 280 with a rotating latch 285 is provided to engage with the tab 240 to form a keyed lock mechanism. While illustrated as having lock cylinder 280 on the cover 250 and tab 240 on the dish 220, it is also possible to have the cylinder and latch portion of the lock on the dish and the engaged portion of the lock on the cover. Similarly, the positions of the tab 230 and recess 270 can also be reversed.

The cover 250 can optionally include a handle 260 and a utensil storage compartment (not shown). The handle 260 illustrated in FIG. 8 is integral with the cover. The handle 260 can take any suitable form and may be foldable or removable. As illustrated, the handle 260 splits into two sections at either end and is preferably formed from dishwasher-safe and microwave-safe material (glass, ceramic, plastic, etc.). When used in a microwave, the handle 260 is preferably fabricated so that it will remain cool to allow a user to grasp the handle 260 to remove the safety dish 210 from the microwave after heating. The dish 220 and elements 240 and 280/285 of the lock mechanism are also preferably formed from dishwasher-safe and microwave-safe materials. Further, if the lock is not microwave-safe (i.e., metal), the cylinder/latch portion of the lock can be removable from the inside so that it remains securely in place when locked.

In general, the materials used for the safety dish should have sufficient strength and stiffness to prevent the cover or lock from being "jimmied" open. Further, while the disclosed combination lock will suffice for ordinary situations such as preventing theft from a common workplace lunchroom refrigerator, such locks are susceptible to defeat from a brute-force approach of trying all permutations or from inspection while in a dishwasher to discover the combination. For greater security, more secure locks should be used.

In a basic embodiment, the safety dish comprises a dish with a base and side walls, a cover for the dish dimensioned to engage the side walls to enclose a food storage area, and a lock mechanism positioned to secure the cover to the dish to prevent unauthorized access to the food storage area. Variations of this embodiment include those wherein: the lock mechanism is selected from a group consisting of a combination lock and a keyed lock, the dish further comprises divider walls to separate food items, the cover further comprises an upwardly extending handle, and those wherein the dish, cover and lock mechanism are formed from microwave-safe materials or dishwasher-safe materials. The basic form can also include a utensil storage compartment, wherein the utensil storage compartment is preferably positioned in the food storage area so as to prevent access and tampering with stored utensils.

In a more particular embodiment, the safety dish comprises a dish with a base and side walls, a cover for the dish dimensioned to engage the side walls to enclose a food storage area, a lock mechanism positioned to secure the cover to the dish to prevent unauthorized access to the food storage area, and further includes a tab on one side of the cover and a first side of the lock mechanism positioned at an opposite side of the cover and a recess on one side of the dish for engaging the tab and a second side of the lock mechanism positioned at an opposite side of the dish to engage the first side of the lock mechanism when the cover is attached to the dish. More particularly, the lock mechanism can be a combination lock comprising a toothed pin that engages rotating discs with notches. Optionally, the cover can include an upwardly extending handle. The materials are preferably dishwasher-safe and microwave-safe.

In another more particular embodiment, the safety dish again comprises a dish with a base and side walls, a cover for the dish dimensioned to engage the side walls to enclose a food storage area, a lock mechanism positioned to secure the cover to the dish to prevent unauthorized access to the food storage area, and further includes a recess on one side of the cover and the lock mechanism positioned at an opposite side of the cover and a pair of tabs on opposite sides of the dish for engaging the recess and the lock mechanism when the cover is attached to the dish. Preferably, the lock mechanism is a key lock comprising a rotating latch that engages a tab on the dish to secure the cover to the dish. Optionally, the cover can include an upwardly extending handle. The materials are preferably dishwasher-safe and microwave-safe.

A safety dish in the form of a locking food container has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the," is not to be construed as limiting the element to the singular.

What is claimed is:

1. A safety dish, comprising:

a dish comprising a base and side walls; and a cover for the dish dimensioned to engage a top of the side walls to enclose a food storage area, wherein the cover includes an upwardly extending handle, a tab on one side, and a first portion of a lock mechanism positioned at an opposite side of the cover, wherein the dish includes a recess on one side for engaging the tab and a second portion of the lock mechanism for engaging with the first portion of the lock mechanism to form a combination lock mechanism positioned to secure the cover to the dish to prevent unauthorized access to the food storage area and thereby create an integral unit comprising the cover secured to the dish, wherein the integral unit comprising the cover secured to the dish is configured to be carried by the upwardly extending handle, and wherein the first portion of the combination lock mechanism is a set of rotating discs with notches and the second portion of the combination lock mechanism is a toothed pin that engages the set of rotating discs with notches.

2. The safety dish of claim 1, wherein the dish, cover and combination lock mechanism are formed from dishwasher-safe materials.

3. The safety dish of claim 2, wherein the combination lock mechanism is removable and the dish and cover are formed from microwave-safe materials.

4. A safety dish, comprising:

a dish comprising a base and side walls; and a cover for the dish dimensioned to engage a top of the side walls to enclose a food storage area, wherein the cover includes an upwardly extending handle, a tab on one side, and a first portion of a lock mechanism positioned at an opposite side of the cover, wherein the dish includes a recess on one side for engaging the tab and a second portion of the lock mechanism for engaging with the first portion of the lock mechanism to form a combination lock mechanism positioned to secure the cover to the dish to prevent unauthorized access to the food storage area and thereby create an integral unit comprising the cover secured to the dish, wherein the integral unit comprising the cover secured to the dish is configured to be carried by the upwardly extending handle, and wherein the dish, cover and combination lock mechanism are formed from microwave-safe materials.

5. A safety dish, comprising:

a dish comprising a base and side walls; and a cover for the dish dimensioned to engage a top of the side walls to enclose a food storage area, wherein the cover includes an upwardly extending handle, a tab on one side, and a first portion of a lock mechanism positioned at an opposite side of the cover, wherein the dish includes a recess on one side for engaging the tab and a second portion of the lock mechanism for engaging with the first portion of the lock mechanism to form a combination lock mechanism positioned to secure the cover to the dish to prevent unauthorized access to the food storage area and thereby create an integral unit comprising the cover secured to the dish, wherein the integral unit comprising the cover secured to the dish is configured to be carried by the upwardly extending handle, and wherein the dish, cover, handle and combination lock mechanism are formed from microwave-safe materials.

* * * * *